US006418571B1

(12) United States Patent
Cheng

(10) Patent No.: US 6,418,571 B1
(45) Date of Patent: Jul. 16, 2002

(54) CHAIR WITH TOILET SINK

(76) Inventor: Yu Wen Cheng, 6F, No. 137-4, Da-Shen Street, Taichung City (TW)

( * ) Notice: Subject to any disclaimer, the term of this patent is extended or adjusted under 35 U.S.C. 154(b) by 0 days.

(21) Appl. No.: 09/858,001

(22) Filed: May 14, 2001

(30) Foreign Application Priority Data

Mar. 22, 2001 (TW) ..... 90204369 U

(51) Int. Cl.[7] ..... A47K 11/06
(52) U.S. Cl. ..... 4/480; 297/188.09
(58) Field of Search ..... 4/480, 483; 297/188.08, 297/188.09, 188.12, DIG. 4; 280/250.1, 304.1

(56) References Cited

U.S. PATENT DOCUMENTS 218,899 A * 8/1879 Reed ..... 4/476
2,644,957 A * 7/1953 Shudde ..... 4/480 X
2,654,899 A * 10/1953 Yaczola ..... 4/480 X
3,261,031 A * 7/1966 Gates ..... 4/480 X
3,381,973 A * 5/1968 Carr ..... 4/480 X
5,669,084 A * 9/1997 Sakimura ..... 4/480
2002/0024196 A1 * 2/2002 Malassigne et al. . 280/250.1 X

FOREIGN PATENT DOCUMENTS

GB 305353 * 1/1928

* cited by examiner

*Primary Examiner*—Charles E. Phillips
(74) *Attorney, Agent, or Firm*—Pro-Techtor International Services

(57) ABSTRACT

A chair has a chair frame, and a seat plate mounted on the chair frame. The seat plate has hole that is wider at the front than at the rear. The chair further includes a container mounted below the hole, and a cushion positioned above the seat plate. The cushion has an opening that is aligned with the hole, with the opening being wider at the rear than at the front. The chair also includes a lid that is fitted inside the opening and supported by portions of the seat plate.

7 Claims, 5 Drawing Sheets

CHAIR WITH TOILET SINK

BACKGROUND OF THE INVENTION

1. Field of the Invention

The present invention relates to a chair with a toilet sink, and in particular, to a chair with a toilet sink having a lid which can be easily removed and replaced.

2. Description of the Prior Art

To help physically challenged or elderly persons, or persons having difficulty in using a toilet on their own, wealthy households take advantage of the availability of nurses. Since employing nurses-can be difficult or expensive, various companies have introduced chairs that are designed for conveniently answering nature's call, to be used by a patient who leaves the bed and has a certain degree of mobility.

One example of such chairs is illustrated in FIG. 6, which shows a chair 90 having a seat plate 91 with a hole 92 provided therein. A toilet sink 93 is mounted below the hole 92 for collecting the excreta and urine. Although this design provides a certain degree of convenience, the existence of the uncovered hole 92 means that the patient will not be able to stay seated on the seat plate 91 for an extended time.

FIG. 7 illustrates another example. To provide more comfortable seating, a cushion or a lid 94 is placed on the seat plate 91, which covers the hole 92 so that the patient can sit comfortably on the cushion 94. Although the chair shown in FIG. 7 allows the patient to answer nature's call as well as to move around comfortably, it suffers from the following shortcomings:

1. When the patient wants to relieve himself or herself, a nurse has to help her or him up, open the lid 94, and carry the patient back on the chair.
2. After usage, the nurse has to lift up the patient again and close the lid 94 to bring the patient back onto the chair.
3. If the patient is an adult person, her or his body is relatively heavy and may not be easy to move. In practice, it is difficult for other persons to lift the patient up from the lid 94 and to put her or him back on the lid 94, as described above.
4. If the lid 94 is not closed, the patient will sit directly on the seat plate 91, which is both uncomfortable and impairs blood circulation in the patient's body.

Thus, there remains a need for a seat that can be used by a patient to answer the call of nature, which avoids the drawbacks set forth above.

SUMMARY OF THE DISCLOSURE

It is an object of the present invention to provide a chair with a toilet sink having a lid which a patient is able to open on her or his own, or with the assistance of a nurse, without having to leave the chair.

It is another object of the present invention is to provide a chair with a toilet sink having a lid which a patient is able to close on her or his own, or with the assistance of a nurse, without having to leave the chair.

In order to accomplish the objects of the present invention, the present invention provides a chair having a chair frame, and a seat plate mounted on the chair frame. The seat plate has hole that is wider at the front than at the rear. The chair further includes a container mounted below the hole, and a cushion positioned above the seat plate. The cushion has an opening that is aligned with the hole, with the opening being wider at the rear than at the front. The chair also includes a lid that is fitted inside the opening and supported by portions of the seat plate.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
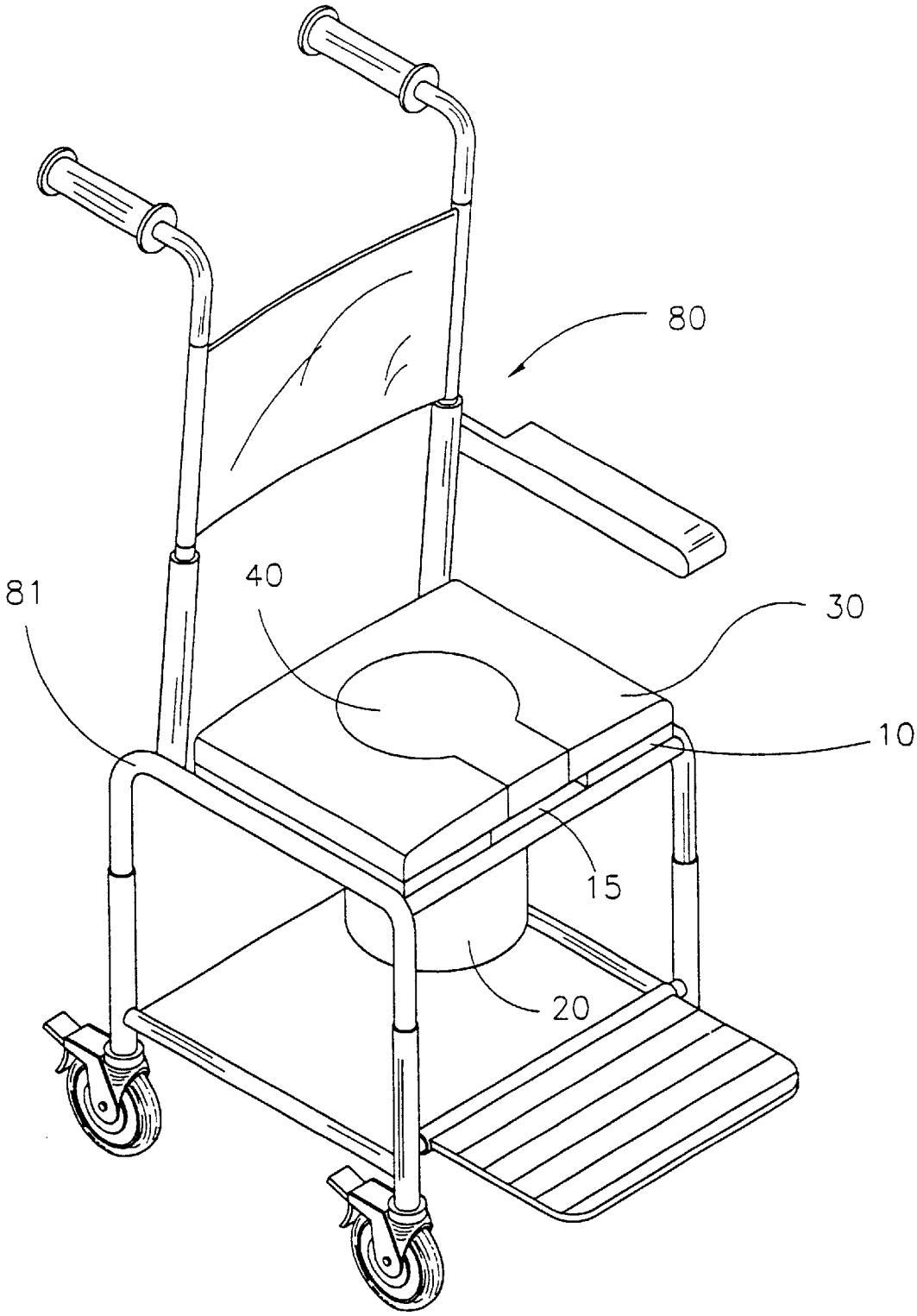
FIG. 1 is a perspective view of a chair having a toilet sink according to the present invention.
Figure 2:
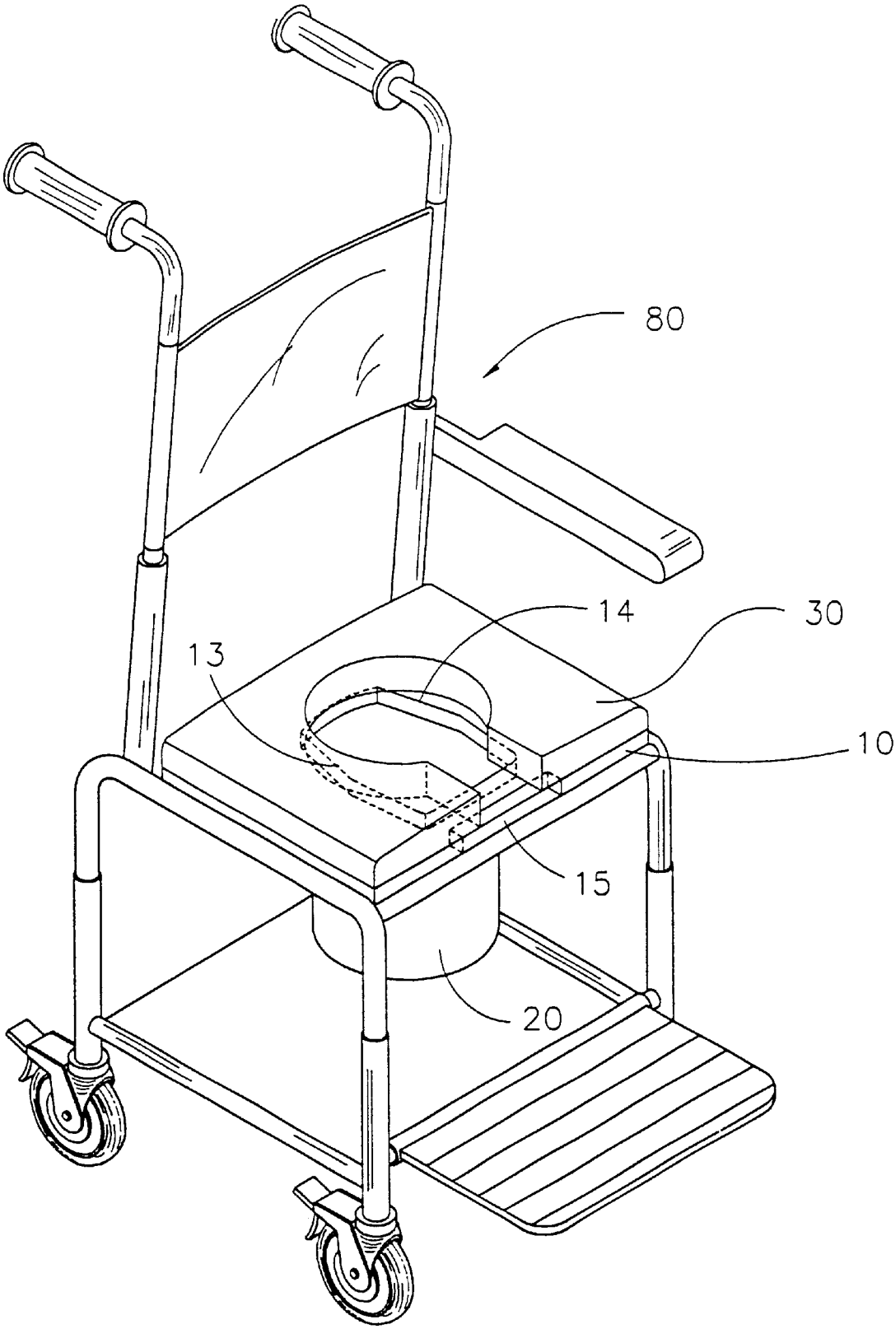
FIG. 2 is a perspective view of the chair of FIG. 1 shown with the lid removed.
Figure 3:
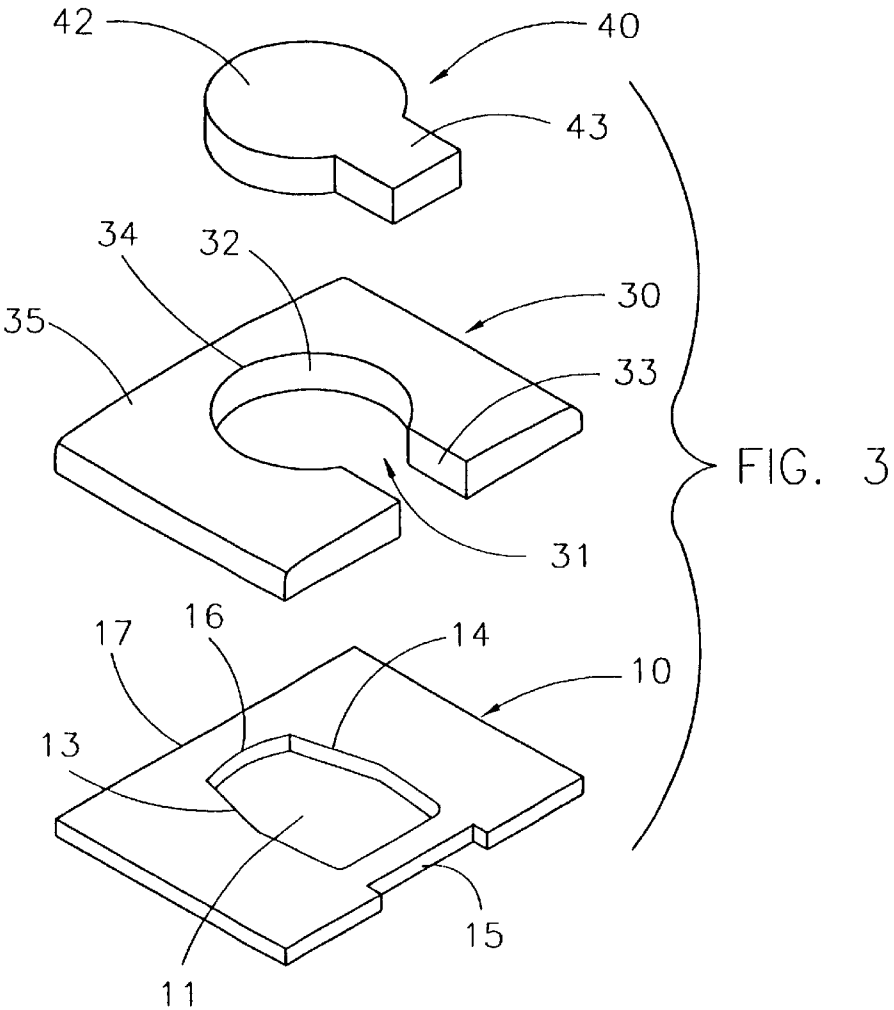
FIG. 3 is an exploded perspective view of the seat plate, the cushion and the lid of the chair of FIG. 1.
Figure 4:
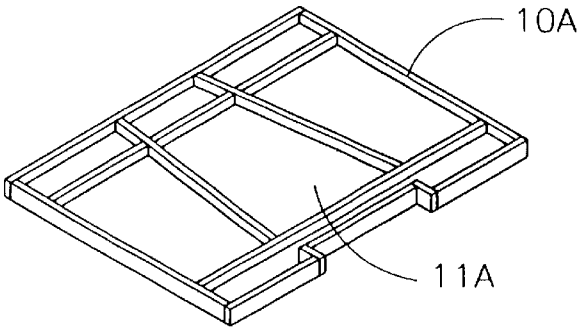
FIG. 4 is a perspective view of the seat plate of the chair of FIG. 1 according to another embodiment thereof.

As shown in FIGS. 1–3, the chair with a toilet sink of the present invention is embodied in the form of a chair 80 having a frame 81 with legs, as well as a front side, lateral sides and a rear side. The chair 80 has a seat plate 10 (or a frame 10A as shown in FIG. 4) having a hole 11, a toilet sink 20 mounted below the hole 11, a cushion 30 adapted to be provided on the seat plate 10 or the frame 10A and having an opening 31 which is narrow at a front edge and widens towards the rear, and a lid 40 adapted to cover the opening 31 to allow a patient to sit comfortably on the chair. In particular, the seat plate 10 is mounted on the chair 80 and can be a regular plate of hard material or a grid frame. The hole 11 is wide at the front edge and narrows towards the rear. The toilet sink 20 is mounted below the seat plate 10 and can be removed from the front side, either of the two lateral sides, or the rear side, of the chair 80. Preferably, a distance of about 15 cm is provided between the rearmost point 16 of the hole 11 and the rear edge 17 of the seat plate 10, as shown in FIG. 3.

The cushion 30 is placed on the seat plate 10 or the frame 10A. The opening 31 in the cushion 30 is narrow at the front edge and widens towards the rear. One possible configuration for the opening 31 is to have a generally circular section 32 at about the center of the cushion 30, with a longitudinal section 33 extending from the circular section 32 through the front edge of the cushion 30. The opening 31 of the cushion 30 has a rearmost point 34 that is farther away from the rear edge 35 of the cushion 30 than the distance between the rearmost point 16 of the hole 11 and the rear edge 17 of the seat plate 10. As a result, inserting the lid 40 is made more convenient. In addition, as shown in FIGS. 1–3, when the cushion 30 is laid on the seat plate 10, lateral segments 13, 14 of the seat plate 10 adjacent the hole 11 are exposed.

The lid 40 can have the same configuration as the opening 31 to fit and cover the opening 31, having a circular section 42 and a longitudinal section 43. The lid 40 can be a body that has a narrow front part (e.g., at 43) and a wider rear part (e.g., at 42), covering the opening 31 of the cushion 30, thereby allowing the patient to sit on the chair 80. When the lid 40 is inserted in the opening 31 of the cushion 30, the narrow front part thereof rests on the front edge of the seat plate 10, and the wider rear part thereof is supported by the lateral segments 13, 14 of the seat plate 10. As a result, when the patient sits on the cushion 30, the lid 40 will not sink in or slide forward.

In addition, a depression 15 can be in the front edge of the seat plate 10, which provides an easier access of user fingers to lift up and remove the lid 40.

In use, when a patient sits on the chair and wants to relieve himself or herself, he or she slightly spreads the legs, uses his or her hand to lift the front edge of the lid 40 and removes the lid 40 in a forward pulling movement. After finishing the bowel movement, the lid 40 can be replaced by the patient slightly spreading his or her legs, then setting the lid 40 at the rear thereof on the rear of the opening 31 of the cushion 30, and then lowering the lid 40 on the front of the cushion 30 until the opening 31 is completely covered. Of course, if the patient moves his or her body slightly to the rear on the cushion 30, it will be easier to pull out and replace the lid 40 since there will be more room to facilitate a smoother movement of the lid 40.

Furthermore, if during use, the patient moves his or her bottom slightly forward to position the bottom right above the opening 31 (like sitting on an actual toilet seat), the cushion 30 will be kept clean.

Figure 5:
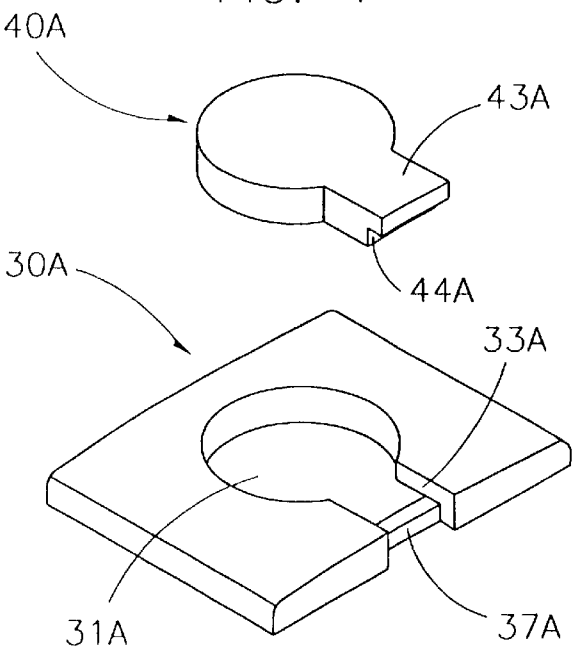
FIG. 5 is an exploded perspective view of the cushion and the lid of the chair of FIG. 1 according to another embodiment thereof.
Figure 6:
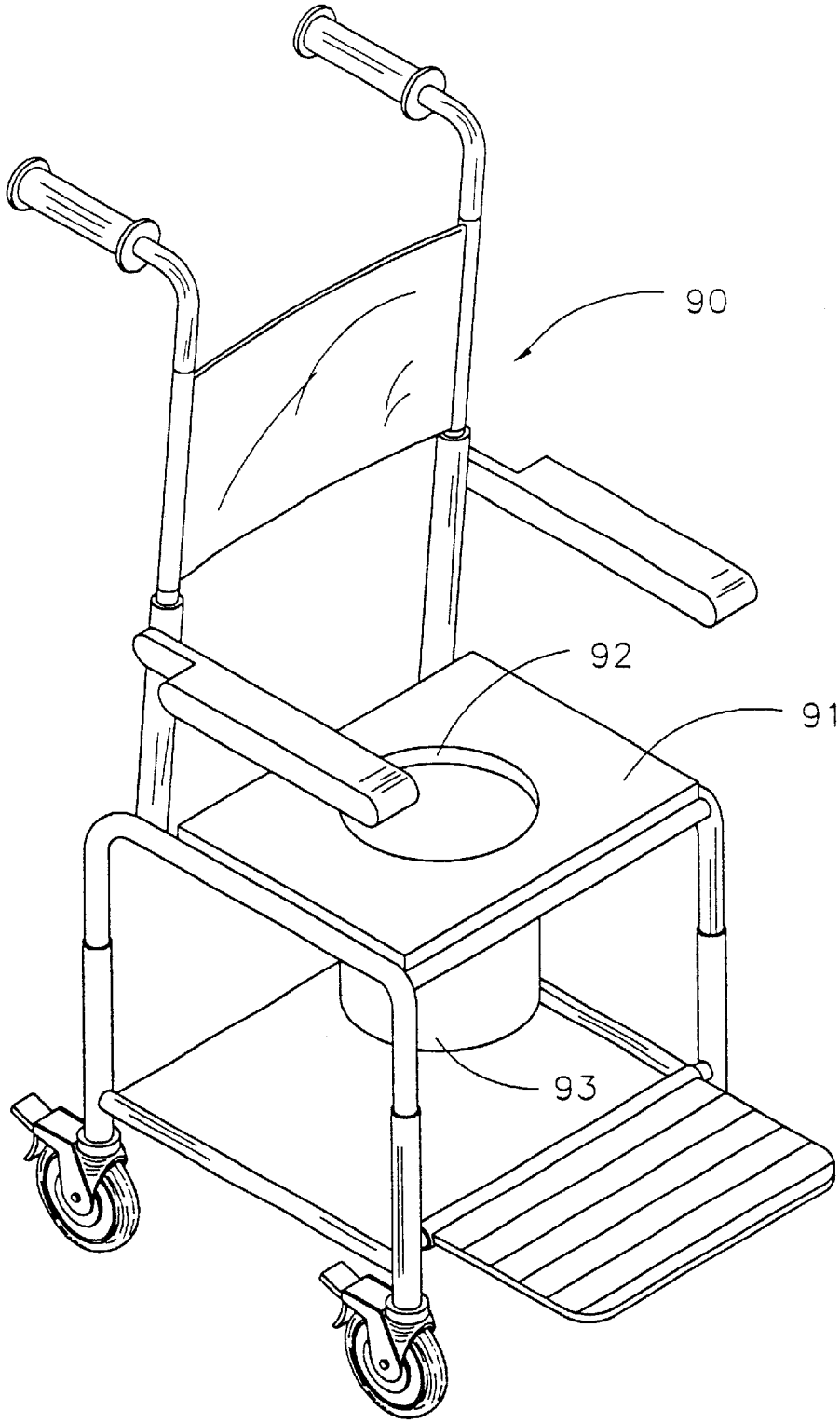
FIG. 6 PRIOR ART
FIG. 6 is a perspective view of a conventional chair having a toilet sink.
Figure 7:
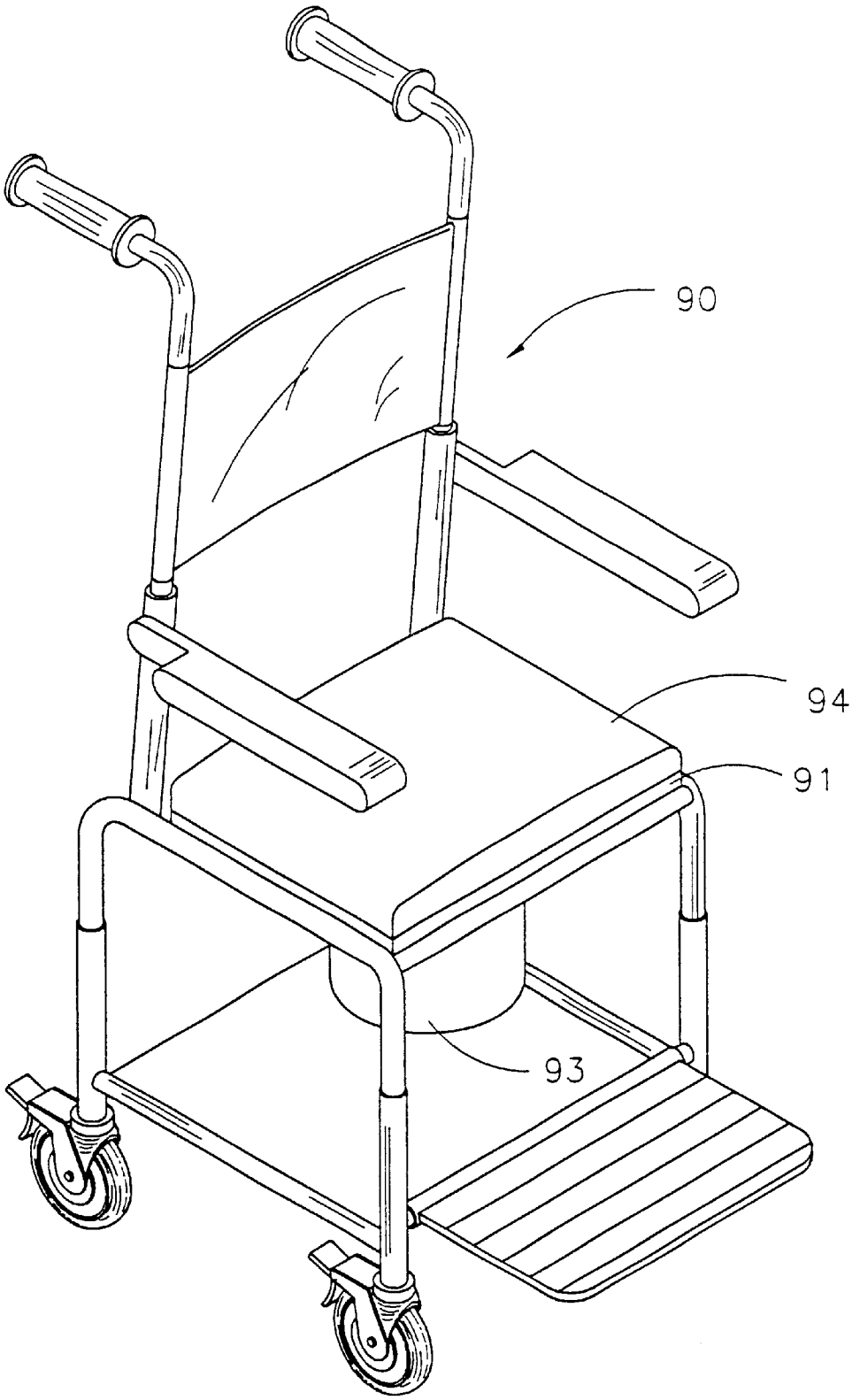
FIG. 7 PRIOR ART
FIG. 7 is a perspective view of another conventional chair having a toilet sink.

FIGS. 4 and 5 illustrate another embodiment according to the present invention. For example, FIG. 4 illustrates an alternative frame 10A that can be substituted for the seat plate 10. The frame 10A can be made of a plurality of rods or ribs, leaving a hole 11A that is wide at the front edge and narrows towards the rear. In addition, FIG. 5 illustrates an alternative cushion 30A and an alternative lid 40A that can be substituted for the cushion 30 and the lid 40. The cushion 30A has an opening 31A that can have a similar configuration as that of opening 31, except that a bar 37A extends across the longitudinal section 33A and closes the opening 31A. The lid 40A is also essentially the same as the lid 40, except that a groove 44A is provided along the front edge of the longitudinal section 43A. The groove 44A is adapted to be engaged by the bar 37A, and to pivot about the bar 37A.

The present invention can be used with either a regular chair or a wheelchair.

The present invention has the following advantages:

1. Due to the shape of the lid 40 being narrow at the front and wider at the rear, there is no risk of the lid 40 sliding when the patient is sitting on the cushion 30 and the lid 40.
2. The shape of the lid 40 being narrow at the front and wider at the rear, and the shape of the opening 11 of the seat plate 10 having being wider at the front and narrower at the rear, ensures that the lid 40 will not sink.
3. The patient, without having to leave the chair, is able to conveniently replace the lid 40 by herself or himself or with the help of a nurse.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A chair, comprising:

a chair frame;

a seat plate mounted on the chair frame, the seat plate having a front and a rear, and a hole that is wider at the front than at the rear;

a container mounted below the hole;

a cushion positioned above the seat plate, the cushion having a front and a rear, and an opening that is aligned with the hole, the opening being wider at the rear than at the front wherein the cushion opening is wider at the rear than the seat plate opening thus exposing portions of the seat plate; and a lid that is fitted inside the opening and supported by said portions of the seat plate.

2. The chair of claim 1, wherein the lid has the same configuration as the opening.

3. The chair of claim 1, wherein said portions of said seat plate are defined by lateral segments that support the lid when the lid is fitted in the opening.

4. The chair of claim 1, wherein the opening has a central circular section and a longitudinal section.

5. The chair of claim 4, wherein the lid has a central circular section and a longitudinal section.

6. The chair of claim 1, wherein the cushion has a front edge, and a bar that extends across an opening at the front edge.

7. The chair of claim 6, wherein the lid has a front edge, and a groove defined along the front edge, with the groove pivoted about the bar.

* * * * *